United States Patent [19]

Goudie

[11] Patent Number: 4,791,761

[45] Date of Patent: Dec. 20, 1988

[54] LOCKABLE DISPLAY FRAME

[75] Inventor: John W. Goudie, Temple Hills, Md.

[73] Assignee: John Goudie Associates, Inc., Brandywine, Md.

[21] Appl. No.: 430,006

[22] Filed: Sep. 30, 1982

[51] Int. Cl.[4] ..... E04B 2/74

[52] U.S. Cl. ..... 52/109; 52/646

[58] Field of Search ..... 52/81, 648, 109, 646; 135/103, 110, 111

[56] References Cited

U.S. PATENT DOCUMENTS

| | | | |
|---|---|---|---|
| 3,053,351 | 9/1962 | Fulcher . | |
| 3,220,152 | 11/1965 | Sturm . | |
| 3,375,624 | 4/1968 | Mikulin . | |
| 3,381,923 | 5/1968 | Berry . | |
| 3,710,806 | 1/1973 | Kelly | 52/109 |
| 3,861,107 | 1/1975 | Papayoti . | |
| 3,968,808 | 7/1976 | Zeigler . | |
| 4,026,313 | 5/1977 | Zeigler . | |
| 4,129,975 | 12/1978 | Gabriel . | |
| 4,276,726 | 7/1981 | Derus . | |
| 4,290,244 | 9/1981 | Zeigler | 52/109 |
| 4,332,501 | 6/1982 | Slysh . | |

FOREIGN PATENT DOCUMENTS 1495511 9/1967 France .

OTHER PUBLICATIONS

Nomadic Structures, Inc. brochure (admitted prior art).
"Unique" brochure in the Swedish language (admitted prior art).
"Genii" Instruction Sheet (admitted prior art).

*Primary Examiner*—John E. Murtagh
*Attorney, Agent, or Firm*—Nixon & Vanderhye

[57] ABSTRACT

A collapsible, articulated structural section which is movable between a stable erect configuration and a collapsed configuration includes a manually actuable positive lock for locking the device in its erect configuration. Four pairs of scissored links connected to exterior pivots at their ends form the exterior of the section, and the interior is formed by a pair of face pivots and four pairs of crossed, but unconnected, face links, each pivotally connected at one end thereof to an exterior pivot and at the other end thereof to a face pivot. A through-extending opening is provided in one face pivot, and a locking component including a shaft portion insertable into the opening, and a rotatable locking member mounted on the end of the shaft, are mounted on the other face pivot.

17 Claims, 2 Drawing Sheets

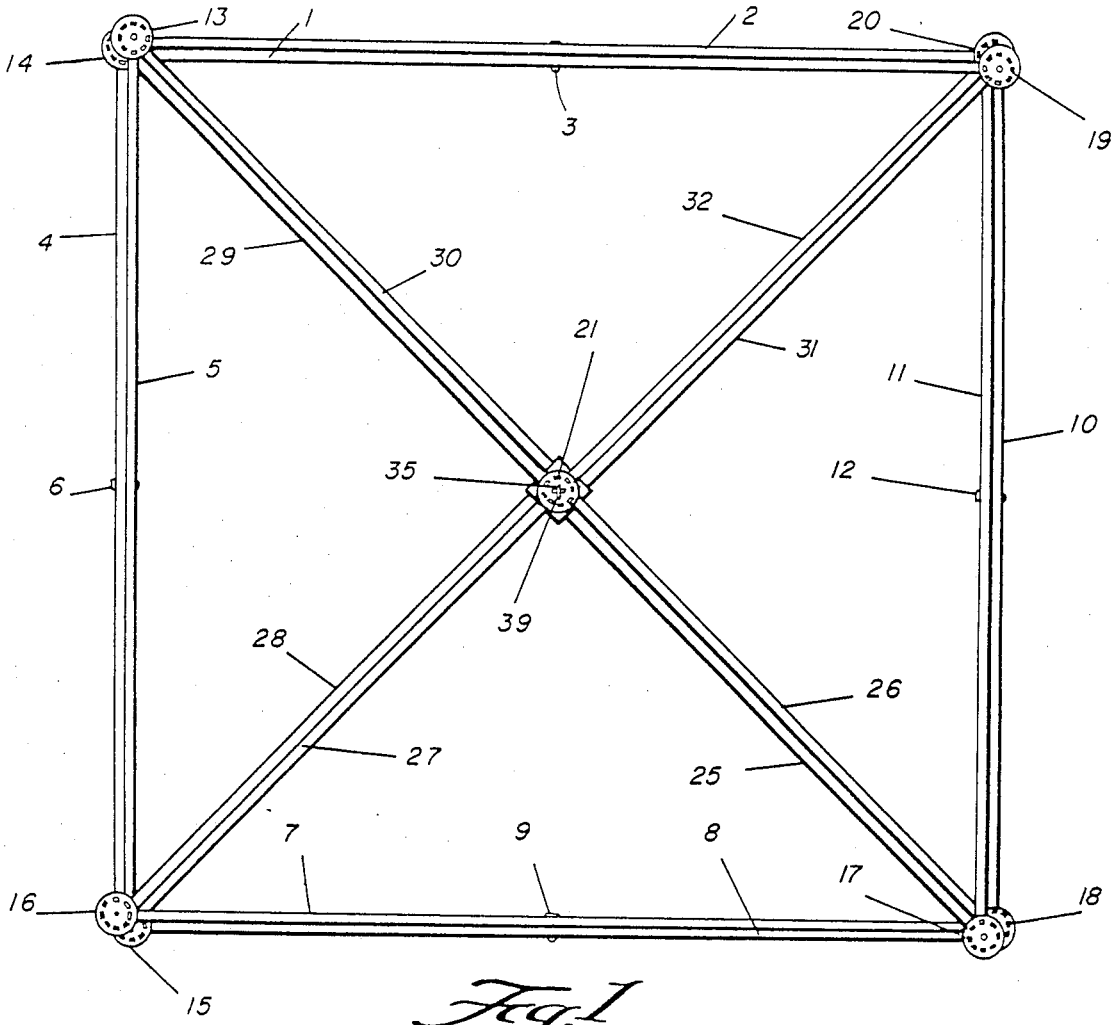
Fig. 1
Fig. 3
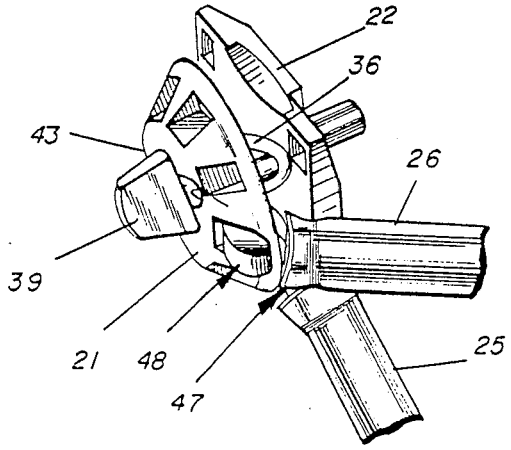
Fig. 5
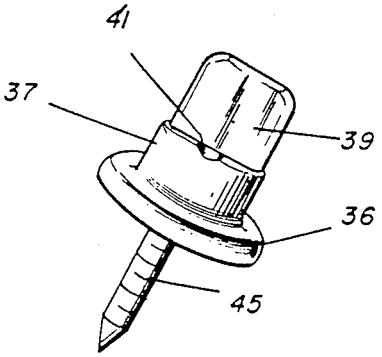

LOCKABLE DISPLAY FRAME

BACKGROUND AND SUMMARY OF THE INVENTION

There are a number of collapsible, articulated frames on the market today, comprised of individual sections connected together, the frame—and each section thereof—movable between a collapsed configuration and a stable erect self-locking configuration. A typical such frame is shown in U.S. Pat. No. 4,276,726. While such frames are very functional, in order to support relatively heavy graphics, or other articles, rather than merely conventional thin Lexan graphic panels (or the like), it is desirable to use accessory brace rods, or like structures, which—after erection of the frame—are added to the structure to hold it in place.

According to the present invention, a collapsible, articulated structural section—and frame formed by a plurality of such sections—is provided which does not require separate accessory brace rods, or the like, yet provides stability that is comparable to that provided when such accessory rods are used. This is accomplished according to the present invention by providing—instead of a self-locking action, which is present in prior art portable exhibit frames—a manually actuated locking component which positively prevents collapse of the lock even when relatively heavy articles, panels and the like are supported by the frame. The manual locks increase set-up time only a small amount compared to conventional self-locking frames, and do not really increase set-up time at all compared to conventional frames when accessory brace rods, and the like are used, while eliminating the need for carrying the accessory brace rods around, making sure that they are detached before collapse, etc.

According to the present invention a first plurality of pivot means are disposed to be spaced from each other and generally in a first plane in the erect configuration, and to be substantially adjacent each other in the collapsed configuration. A second plurality of pivot means are also disposed to be spaced from each other and generally in a second plane in the erect configuration and to be substantially adjacent each other in the collapsed configuration. A plurality of pivotally interconnected side links are provided for connecting the first plurality of pivot means with the second plurality of pivot means, each of the side links being connected with one of the first plurality of pivot means and one of the second plurality of pivot means. First and second face pivot means are provided, and a first and a second plurality of face links, each of the first plurality of face links connected with the first face pivot means and with one of the first pivot means, and each of the second plurality of face links connected with the second face pivot means and one of the second pivot means.

Unique to the invention, each of the first plurality of face links crosses, but is unconnected to, one of the second plurality of face links (the first face pivot means is located closer to the second pivot means than it is to the first pivot means when the section is in the collapsed configuration). A first locking component is associated with the first pivot means and a second locking component is associated with the second pivot means, the first and second locking components comprising means—upon manual actuation—for holding the first and second face pivot means adjacent each other and to thereby hold the structural section in its stable erect configuration. A structural section is usually provided in combination with a plurality of substantially identical structural sections, with adjacent structural sections sharing some common first and second pivot means, and a common pair of side links, to provide a complete and portable display frame. Graphics are preferably attached to the display frame in the manner illustrated in U.S. Pat. No. 4,471,548 (the disclosure of which is hereby incorporated by reference herein).

A particularly advantageous, simple, and effective manually actuated locking structure for use in the structural section according to the present invention comprises a first locking component comprising means defining a through-extending opening in the first face pivot means, and a second locking component comprising a central shaft with a rotatable locking member. The central shaft of the second locking component extends from the second face pivot means towards the first face pivot means and has a free end on a portion thereof remote from the second face pivot means, the free end including a shaft termination portion dimensioned to fit in the first face pivot means opening. Preferably both the opening and the shaft end terminating portion are oval. The rotatable locking member is on the end of the shaft terminating portion and is mounted to the shaft by means providing rotation thereof from a first position in-line with the shaft end termination so that it can pass through the first face pivot means opening, to a second position not in-line wit the shaft end termination so that the locking member engages the first face pivot means on the opposite end thereof from the second face pivot means. Preferably the rotatable locking member is held in a detent position in both the first and second positions thereof, the second position being 90° from the first position.

In a commercial frame produced according to the present invention, there usually will be four first pivot means, four second pivot means, eight side links, four first face links, and four second face links for each section, with adjacent structural sections sharing two common first pivot means, two common second pivot means, and a common pair of side links.

It is the primary object of the present invention to provide a simple, yet stable, structural section, and lockable display frame constructed from such a structural section. This and other objects of the invention will become clear from an inspection of the detailed description of the invention, and from the appended claims.

BRIEF DESCRIPTION OF THE DRAWINGS.

FIG. 1 is a front view of an exemplary structural section according to the present invention when the section is in its stable erect configuration;

FIG. 3 is a perspective detail view showing the interrelationship the face pivot means and face links, when the section is in its stable erect configuration;

FIG. 5 is a perspective view of the exemplary second locking component of the section of FIGS. 1 through 4.

DETAILED DESCRIPTION OF THE DRAWINGS

Figure 2:
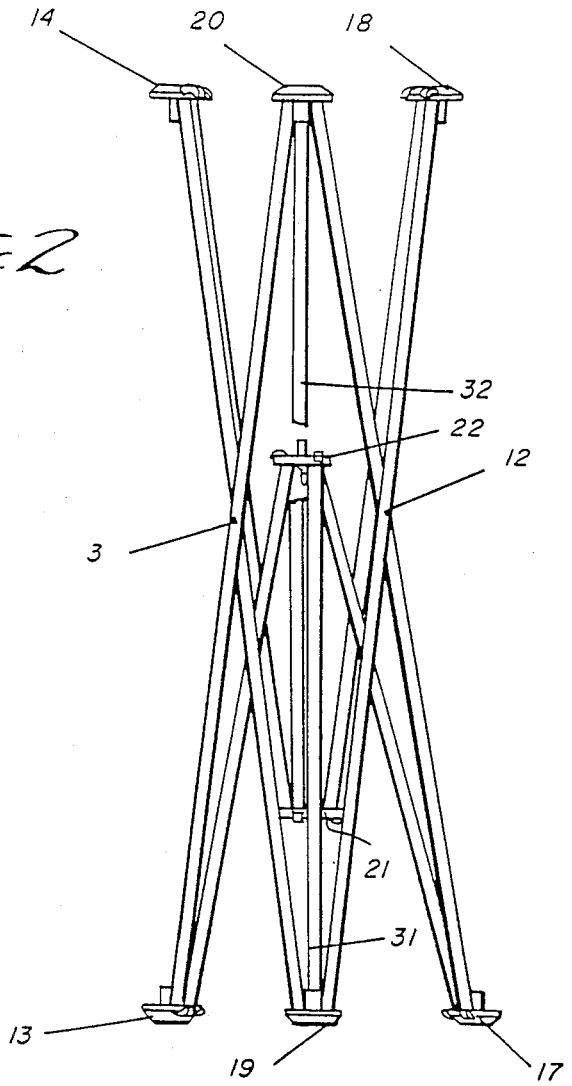
FIG. 2 is a side view of the section of FIG. 1 when in a collapsed configuration.

The exemplary collapsible, articulated structural section shown in the drawings is movable between the stable erect configuration of FIG. 1 and the collapsed configuration of FIG. 2. For the exemplary embodiment illustrated, eight pivotally interconnected side links 1, 2, 4, 5, 7, 8, and 10, 11 are provided. The links preferably are of aluminum tubing, and are pivotally connected together by pivoted pivot pins 3, 6, 9, and 12, respectively. Preferably the side links are pivotally connected at the centers thereof so that the erected section has front and rear truly flat faces. However, if it is desired that the section assume a curvature (and a frame constructed from a plurality of such sections have such a curvature), the pivot pins 3, 9 will be located off-center.

The structural section illustrated in the drawings also includes a first plurality of pivot means 14, 15, 18, and 20 spaced from each other and generally in a first plane in the erect configuration (FIG. 1), and substantially adjacent each other in the collapsed configuration (FIG. 2). A second plurality of pivot means 13, 16, 17, and 19 also are disposed to be spaced from each other and generally in a second plane in the erect configuration (FIG. 1) and to be substantially adjacent other in the collapsed configuration (FIG. 2).

First and second face pivot means 21, 22 are provided. Also there are provided a first plurality of face links 26, 27, 29, and 32, each of the first plurality of face links connected at one end thereof with the first face pivot means 21 (see FIGS. 3 and 4), and pivotally connected at the other end thereof with a respective first pivot means (i.e., face link 26 is pivotally connected to both first face pivot means 21 and first pivot means 18). A second plurality of face links 25, 28, 30, and 31 are provided, each pivotally connected at one end thereof with the second face pivot means 22, and at the opposite end thereof with a respective one of the second pivot means (i.e, face link 25 is connected to second face pivot means 22 and second pivot means 17).

The face links 25–32—like the side links preferably are formed of aluminum tubing. The first and second face pivot means 21, 22 and the first and second pivot means 13 through 20 are preferably all formed of injection molded plastic.

What has been described so far is conventional. Unique according to the present invention is the disposition of the first and second plurality of face links so that each of the first-plurality of face links crosses, but is unconnected to, one of the second plurality of face links. This is illustrated most clearly in FIG. 3, wherein one of the first plurality of face links 26 crosses one of the second plurality of face links 25, however there is no pivotal—or other—connection therebetween. In fact in normal use there will not even be any tangential surface-to-surface engagement thereof, although there may be some incidental tangential contact at some point during movement of the face links between the collapsed and erect configurations. As illustrated in FIG. 2, the first face pivot means 2.1 is located closer to the second pivot means 13, 16, 17 than it is to be the first pivot means 14, 15, 18, 20 in the collapsed configuration.

Since the first and second plurality of face links 25–32 are unconnected, the structural section heretofore described will not maintain itself in a stable erect configuration. In Order to maintain the section in the stable erect configuration manually actuated locking means are provided comprising a first locking component associated with the first face pivot means 21, and a second locking component associated with the second face pivot means 22. The first and second locking components comprise means, upon manual actuation, for holding the first and second face pivot means 21, 22 adjacent each other (see FIG. 3) and to thereby hold the structural section in its stable erect configuration (FIG. 1).

Figure 4:
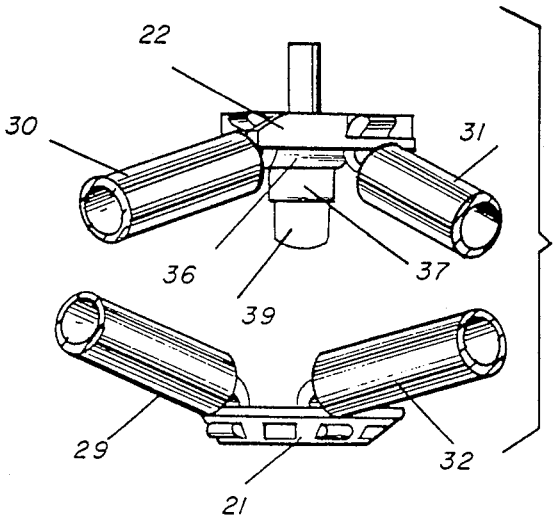
FIG. 4 is a top detail view, partly in cross-section and partly in elevation, showing the first and second face pivot means spaced from each other.

While a number of manually actuated locking components, such as male and female snap fasteners, may be suitable, a particularly advantageous, simple, yet very effective locking means is illustrated in the drawings, particularly FIGS. 3 through 5 thereof. The first locking component of such locking means comprises means defining a through-extending opening 35 in the first face pivot means 21, the opening 35 being concentric with the first face pivot means 21 (and the first and second face pivot means 21, 22 being concentric with each other). The second locking component comprises a central shaft 36 extending from the second face pivot means 22 toward the first face pivot means 21, and having a free end and a portion thereof remote from the second face pivot means 22, the free end including a shaft terminating portion 37 dimensioned to fit in the first face pivot means opening 35. Preferably both the opening 35 and the shaft termination 37 are oval in plan, with the outside dimensions of the shaft terminating end 37 substantially identical to the dimensions of the opening 35. A rotatable (i.e., pivotal) locking member 39 is mounted to the shaft 36 by means providing rotation thereof from a first position (FIG. 5) in-line with the shaft end termination 37 so that the member 39 may pass through the opening 35, to a second position (FIGS. 1 and 3)—the second position preferably being 90° with respect to the first position—not in-line with the shaft end termination 37 so that the locking member 39 engages the first face pivot means 21 on an opposite end thereof from the second face pivot means 22 (see FIG. 3).

The second locking component preferably includes detents between the shaft terminating portion 37 and rotatable locking member 39 at the first and second positions thereof, which detents may be formed by slight facial depressions 41 (see FIG. 5) in the shaft terminating portion 37 and cooperating small projections 43 at opposite ends of the rotatable member 39. The second locking component preferably is a commercially available fastener available from Ohio Travel Bag Manufacturing Company of Cleveland, Ohio (e.g., Model No. 78324). As illustrated in FIG. 5, the shaft 36 may be connected to the second pivot means 22 by a screw fastener 45 integral therewith.

In forming a graphics-support frame according to the present invention, a plurality of the structural sections are interconnected together so that adjacent sections share a pair of first and second pivot means (e.g., 17 through 20) and a pair of side links (e.g., 10, 11), as shown more clearly in U.S. Pat. No. 4,471,548, the disclosure of which is hereby incorporated by reference herein. Graphic panels are preferably mount on the structure in the manner illustrated in said U.S. Pat. No. 4,471,548. Further, where it is desirable to provide a bend in the frame being produced at one intermediate section (i.e., having at least one section on either side thereof), or a row of intermediate sections, the pivots for the top and bottom side links (i.e., pivot pins 3, 9) are removed, allowing the structure to open in a manner illustrated in U.S. Pat. No. 4,481,548. In such a situation, the first and second locking components will not be used, or the shaft 36 of the second locking component will be greatly extended vis-a-vis a typical section (as illustrated in the present drawings), so that locking can still be accomplished.

Note that the second face pivot means 22 preferably is square in top plan, while the first pivot means 21 is round in top plan. In order to minimize or eliminate any engagement whatsoever between the first plurality of face links 26, 27, 29, 32 and the second plurality of face links 25, 28, 30 and 31, the second plurality of face links are mounted to the second pivot means 22 at a position more radially outward from the common center line of the face pivot means 21, 22 than the point of pivotal attachment of the respective first face link to the first face pivot means. That, with respect to FIG. 3, the pivotal connection 47 of second face link 25 to the second face pivot means 22 is more radially outward from the common center line of the face pivot means 21, 22 than is the point of pivotal connection 48 of the second face link 26 to the second face pivot means 21. One desirable effect that this mounting contributes to is to assist in automatically moving the second locking component out of the opening 35 (e.g., to the position illustrated in FIG. 4) as soon as the rotatable locking member 39 is rotated to a position in-line with the terminating portion 37. Thus as soon as the last locking components of a complete frame are manually deactivated, the entire frame will collapse, yet when all the locking components are manually activated the frame will be very sturdy and stable.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A collapsible, articulated structural section which is movable between a stable erect configuration and a collapsed configuration, said structure comprising:

a first plurality of pivot means disposed to be spaced from each other and generally in a first plane in said erect configuration, and to be substantially adjacent each other in said collapsed configuration; a second plurality of pivot means disposed to be spaced from each other and generally in a second plane in said erect configuration and to be substantially adjacent each other in said collapsed configuration; a plurality of pivotally interconnected side links for connecting said first plurality of pivot means with said second plurality of pivot means, each of said side links being connected with one of said first plurality of pivot means and one of said second plurality of pivot means; first and second face pivot means; and a first and a second plurality of face links, each of said first plurality of face links pivotally connected with said first face pivot means and with one of said first pivot means, and each of said second plurality of face links pivotally connected with said second face pivot means and with one of said second pivot means;

each of said first plurality of face links crossing, but unconnected to one of said second plurality of face links; said first face pivot means being located closer to said second pivot means than it is to said first pivot means when said structural section is in said collapsed configuration; and a first locking component associated with said first face pivot means, and a second locking component associated with said second face pivot means, said first and second locking components comprising means, upon manual actuation, for holding said first and second face pivot means adjacent each other and to thereby hold said structural section in said stable erect configuration; and wherein said first locking component comprises means defining a through-extending opening in said first face pivot means, and wherein said second locking component comprises a central shaft extending from said second face pivot means towards said first face pivot means and having a free end on a portion thereof remote from said second face pivot means, said free end including a shaft terminating portion dimensioned to fit in said first face pivot means opening, and a rotatable locking member on the end of said shaft terminating portion, said rotatable locking member mounted to said shaft by means providing rotation thereof from a first position in-line with said shaft end termination so that it can pass through said first face pivot means opening, to a second position not in-line with said shaft end termination so that said locking member engages said first face pivot means on an opposite end thereof from said second face pivot means.

2. A structural section as recited in claim 1 wherein said shaft end termination and said first face pivot means are oval.

3. A structural section as recited in claim 1 wherein there are four first pivot means, four second pivot means, eight side links, four first face links, and four second face links.

4. A structural section as recited in claim 3, in combination with a plurality of substantially identical structural sections, adjacent structural sections sharing some common first and second pivot means, and a common pair of side links.

5. A structural section as recited in claim 1 wherein said first and second face pivot means are concentric, and wherein said second plurality of face links are pivotally connected to said second face pivot means at points thereon further radially outwardly from said concentric center than the points of pivotal connection of said first plurality of face links to said first pivot means, so that during movement of said structural section between said erect and said collapsed configurations there is minimal, or no, frictional engagement between said first and second pluralities of face links.

6. A section as recited in claim 1 wherein said side links and said first and second plurality of face links are formed of aluminum tubing.

7. A structural section as recited in claim 3 wherein one pair of opposite side links are pivoted to each other at the centers thereof, and the other opposite pairs of side links are pivoted to each other off-center.

8. A structural section as recited in claim 1, in combination with a plurality of substantially identical structural sections, adjacent structural sections sharing some common first and second pivot means, and a common pair of side links.

9. A structural section as recited in claim 1 wherein said structural section comprises a first structural section; and in combination with a second structural section substantially identical to said first structural section; and a third structural section disposed intermediate said first and second structural sections, said third structural section including first and second face pivot means and a first and a second plurality of face links, each of said face links connected with a respective face pivot means and with one of said pivot means of said first or second structure; and a pair of side links which cross each other, each of side links being connected at one end thereof to a first pivot means of one of said first and second structures and connected at the other end thereof to a second pivot means of the other links being completely unconnected to each other so that free relative linear movement therebetween is possible, all side links associated with said third structural section not in common with said first and second structural sections being unconnected to each other.

10. A structural section as recited in claim 1 wherein said second locking component comprises means providing a detent at said first position, and at said second position, which second position is 90° from said first position.

11. A structural section as recited in claim 1 wherein said second locking component is anchored to said second face pivot means by a screw integral with said second locking component.

12. A collapsible, articulated structural section which is movable between a stable erect configuration and a collapsed configuration, said structure comprising:

a first plurality of pivot means disposed to be spaced from each other and generally in a first plane in said erect configuration, and to be substantially adjacent each other in said collapsed configuration; a second plurality of pivot mean disposed to be spaced from each other and generally in a second plane in said erect configuration and to be substantially adjacent each other in said collapsed configuration; a plurality of pivotally interconnected side links for connecting said first plurality of pivot means with said second plurality of pivot means, each of said side links being connected with one of said first plurality of pivot means and one of said second plurality of pivot means; first and second face pivot means; and a first and a second plurality of face links, each of said first plurality of face links pivotally connected with said first face pivot means and with one of said first pivot means, and each of said second plurality of face links pivotally connected with said second face pivot means and with one of said second pivot means;

each of said first plurality of face links crossing, but unconnected to, one of said second plurality of face links; and a first locking component associated with said first face pivot means, and a second locking component associated with said second face pivot means, said first and second locking components being adjacent each other in said stable condition and comprising means for holding said first and second face pivot means to each other in a position requiring manual release in order to allow said structural section to move from its stable, erect configuration to said collapsed configuration; and wherein said first locking component comprises means defining a through-extending opening in said first face pivot means, and wherein said second locking component comprises a central shaft extending from said second face pivot means towards said first face pivot means and having a free end on a portion thereof remote from said second face pivot means, said free end including a shaft terminating portion dimensioned to fit in said first face pivot means opening, and a rotatable locking member on the end of said shaft terminating portion, said rotatable locking member mounted to said shaft by means providing rotation thereof from a first position in-line with said shaft end termination so that it can pass through said first face pivot means opening, to a second position not in-line with said shaft end termination so that said locking member engages said first face pivot means on an opposite end thereof from said second face pivot means.

13. A collapsible, articulated structural section which is movable between a stable erect configuration and collapsed configuration, said structure comprising:

a first plurality of pivot means; a second plurality of pivot means; a plurality of pivotally interconnected side links for interconnecting said first plurality of pivot means with said second plurality of pivot means, each of said side links being connected with one of said first plurality of pivot means and one of said second plurality of pivot means; first and second face pivot means; a first and a second plurality o face links, each of said first plurality of face links pivotally connected with said first face pivot means and with one of said first pivot means, and each of said second plurality of face links pivotally connected with said second face pivot means and with one of said second pivot means; each of said first plurality of face links crossing, but unconnected to, one of said second plurality of face links; a first locking component associated with said first face pivot means, and a second locking component associated with said second face pivot means; said first locking component comprising means defining a through-extending opening in said first face pivot means, and wherein said second locking component comprises a central shaft extending from said second face pivot means towards said first face pivot means and having a free end on a portion thereof remote from said second face pivot means, said free end including a shaft terminating portion dimensioned to fit in said first face pivot means opening and cooperable therewith to releasably hold said first and second face pivot means adjacent each other in said stable erect configuration.

14. A structural section as recited in claim 13 wherein said structural section comprises a first structural section; and in combination with a second structural section substantially identical to said first structural section; and a third structural section disposed intermediate said first and second structural sections, said third structural section including first and second face pivot means and a first and a second plurality of face links, each of said face links connected with a respective face pivot means and with one of said pivot means of sad first or second structure; and a pair of side links which cross each other, each of side links being connected at one end thereof to a first pivot means of one of said first and second structures and connected at the other end thereof to a second pivot means of the other of said first and second structures, said crossed side links being completely unconnected to each other so that free relative linear movement therebetween is possible, all side links associated with said third structural section not in common with said first and second structural sections being unconnected to each other.

15. A collapsible, articulated structural section which is movable between a stable erect configuration and a collapsed configuration, said structure comprising:

a first plurality of pivot means disposed to be spaced from each other and generally in a first plane in said erect configuration, and to be substantially adjacent each other in said collapsed configuration; a second plurality of pivot means disposed to be spaced from each other and generally in a second plane in said erect configuration and to be substantially adjacent each other in said collapsed configuration; a plurality of pivotally interconnected side links for connecting said first plurality of pivot means with said second plurality of pivot means, each of said side links being connected with one of said first plurality of pivot means and one of said second plurality of pivot means; first and second face pivot means; and a first and a second plurality of face links, each of said first plurality of face links pivotally connected with said first face pivot means and with one of said first pivot means, and each of said second plurality of face links pivotally connected with said second face pivot means and with one of said second pivot means;

each of said first plurality of face links crossing, but unconnected to one of said second plurality of face links; and first face pivot means being located closer to said second pivot means than it is to said first pivot means when said structural section is in said collapsed configuration; and a first locking component associated with said first face pivot means, and a second locking component associated with said second face pivot means, said first and second locking components comprising means, upon manual actuation, for holding said first and second face structural section in said stable erect configuration; and wherein said first and second face pivot means are concentric, and wherein said second plurality of face links are pivotally connected to said second face pivot means at points thereon further radially outwardly from said concentric center than the point of pivotal connection of said first plurality of face links to said first pivot means, so that during movement of said structural section between said erect and said collapsed configurations there is minimal, or no, frictional engagement between said first and second pluralities of face links.

16. A structural section as recited in claim 15 wherein said second face pivot means is square in plan, and said first face pivot means is round in plan.

17. A section as recited in claim 15 wherein said side links and said first and second plurality of face links are formed of aluminum tubing.

* * * * *